US006955529B2

(12) United States Patent
Tsai

(10) Patent No.: US 6,955,529 B2
(45) Date of Patent: Oct. 18, 2005

(54) BIDIRECTIONAL AIR PUMP ASSEMBLY FOR INFLATABLE OBJECTS

(75) Inventor: Lung-Po Tsai, Taipei Hsien (TW)

(73) Assignee: Ho Lee Co., Ltd., Taipei Hsien (TW)

( * ) Notice: Subject to any disclaimer, the term of this patent is extended or adjusted under 35 U.S.C. 154(b) by 140 days.

(21) Appl. No.: 10/733,082

(22) Filed: Dec. 11, 2003

(65) Prior Publication Data

US 2005/0129541 A1 Jun. 16, 2005

(51) Int. Cl.[7] ..... F04B 35/04
(52) U.S. Cl. ..... 417/423.15; 417/423.1; 417/360
(58) Field of Search ..... 73/168; 417/423.15, 417/360

(56) References Cited

U.S. PATENT DOCUMENTS 6,296,459 B1 * 10/2001 Saputo et al. ..... 417/423.14
6,623,248 B1 * 9/2003 Tempel et al. ..... 417/118
6,679,686 B2 * 1/2004 Wang ..... 417/423.1
2004/0123396 A1 * 7/2004 Wang ..... 5/713
2005/0079077 A1 * 4/2005 Tsai et al. ..... 417/423.15

* cited by examiner

*Primary Examiner*—Hezron Williams
*Assistant Examiner*—Katina Wilson
(74) *Attorney, Agent, or Firm*—Hedman & Costigan, P.C.

(57) ABSTRACT

A bidirectional air pump assembly includes a pump mounting case, a valve and an air pump. The pump mounting case is mounted in an inflatable object and has a valve mounting hole. The valve is held in the valve mounting hole and includes an adapter with a valve port and a valve disk. The valve disk is attached to the adapter and has a disk body and at least one disk stop protruding from the disk body. The air pump is detachably mounted in the pump mounting case and connects to the valve port. Therefore, the air pump draws air out of the inflatable body through the valve port and a gap caused by the at least one disk stop abutting the air pump, which keeps the disk body from completely closing the valve port.

4 Claims, 7 Drawing Sheets

BIDIRECTIONAL AIR PUMP ASSEMBLY FOR INFLATABLE OBJECTS

BACKGROUND OF THE INVENTION

1. Field of the Invention

The present invention relates to a bidirectional air pump assembly for inflatable objects, and more particularly to an air pump assembly that is used to either pump air into or draw air out of an inflatable object.

2. Description of Related Art

Inflatable objects are convenient to use for exhibitions, children's playgrounds, decorations, etc. and use air pumps to force ambient air into the inflatable object to inflate the object to a huge size. An air pump in accordance with the prior art only can pump the air into the inflatable object but is unable to draw air out of the inflatable object. Even though the inflatable object is convenient to use, using the inflatable object still has some shortcomings. For example, a long time is required to vent or discharge the air from an inflated inflatable object so the inflatable object can be stored. A person needs to press the inflated object to squeeze the air out of the inflatable object. Manually squeezing the air out of the inflatable object is really burdensome work and takes a long time. Removing the air from a huge inflatable object can be especially boring work.

To overcome the shortcomings, the present invention provides a bidirectional air pump assembly for an inflatable object to mitigate or obviate the aforementioned problems.

SUMMARY OF THE INVENTION

The main objective of the invention is to provide a bidirectional air pump assembly for an inflatable object, which can be used to either pump air into or draw air out of an inflatable object to save time and work.

To achieve the aforesaid objective, a bidirectional air pump assembly for inflatable objects includes a pump mounting case, a valve and an air pump. The pump mounting case is mounted inside the inflatable object and has a top cavity and a valve mounting hole communicating with the top cavity. The valve is fitted and held in the valve mounting hole and includes an adapter and a valve disk. The adapter is mounted in the valve mounting hole and has a valve port to facilitate the inside of the inflatable object to communicate with the top cavity. The valve disk is attached to the adapter and has a disk body and at least one disk stop formed on and protruding from the disk body. The air pump is detachably mounted in the top cavity and has a supply port and a discharge port that selectively connect to the valve port in the adapter. Therefore, the air inside the inflatable object will be drawn out through the valve port and a gap caused by the at least one disk stop abutting the air pump when the supply port of the air pump connects to the valve port.

Other objectives, advantages and novel features of the invention will become more apparent from the following detailed description when taken in conjunction with the accompanying drawings.

DETAILED DESCRIPTION OF PREFERRED EMBODIMENT

Figure 1:
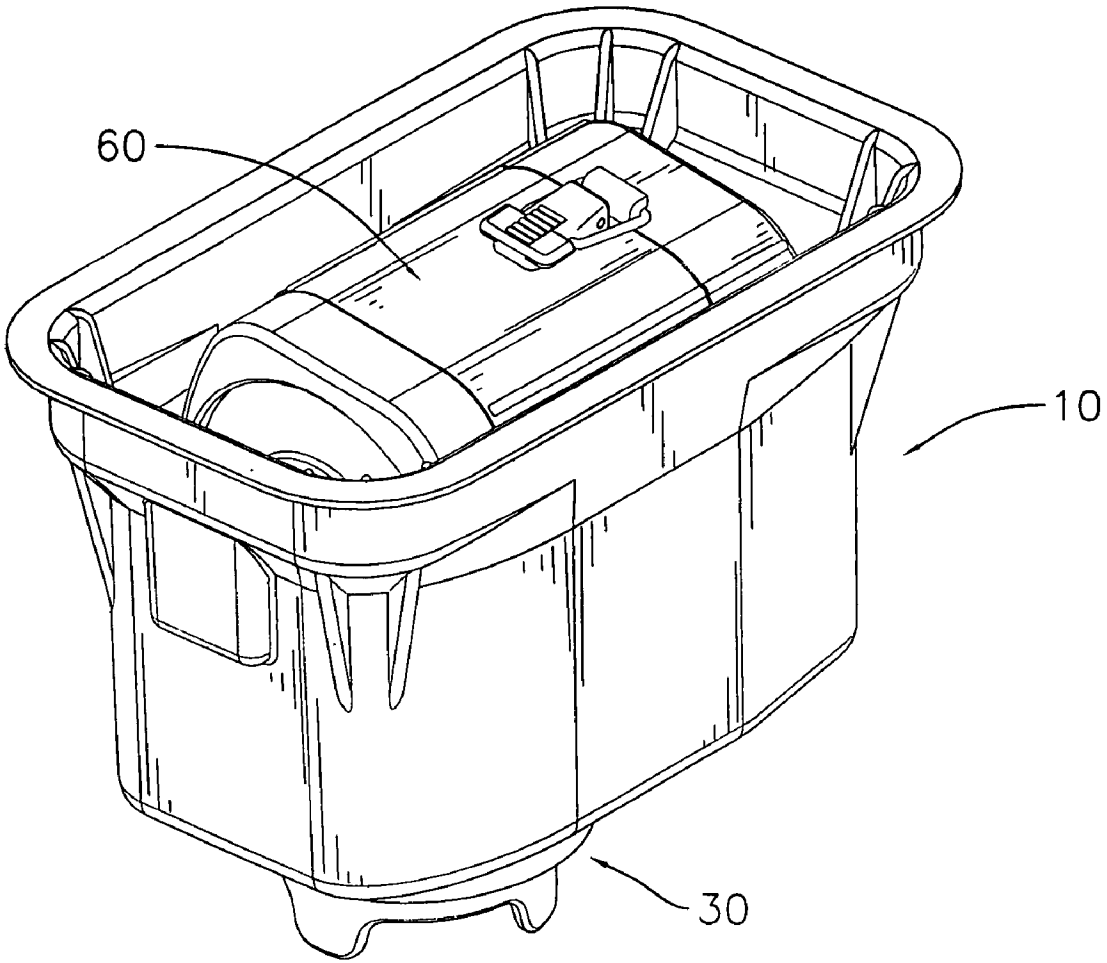
FIG. 1 is a perspective view of a bidirectional air pump assembly in accordance with the present invention.
Figure 2:
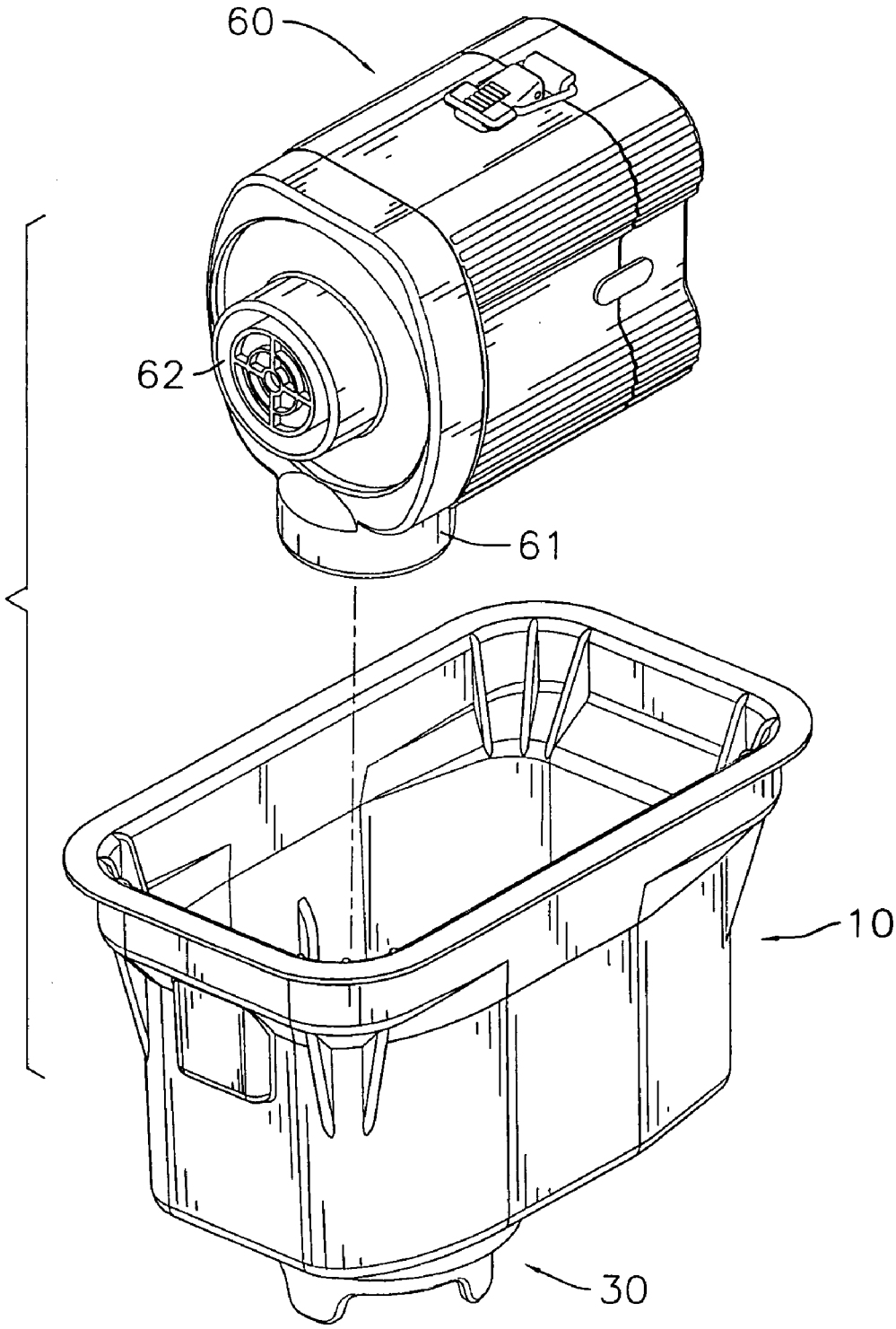
FIG. 2 is a partially exploded perspective view of the bidirectional air pump assembly in FIG. 1.
Figure 3:
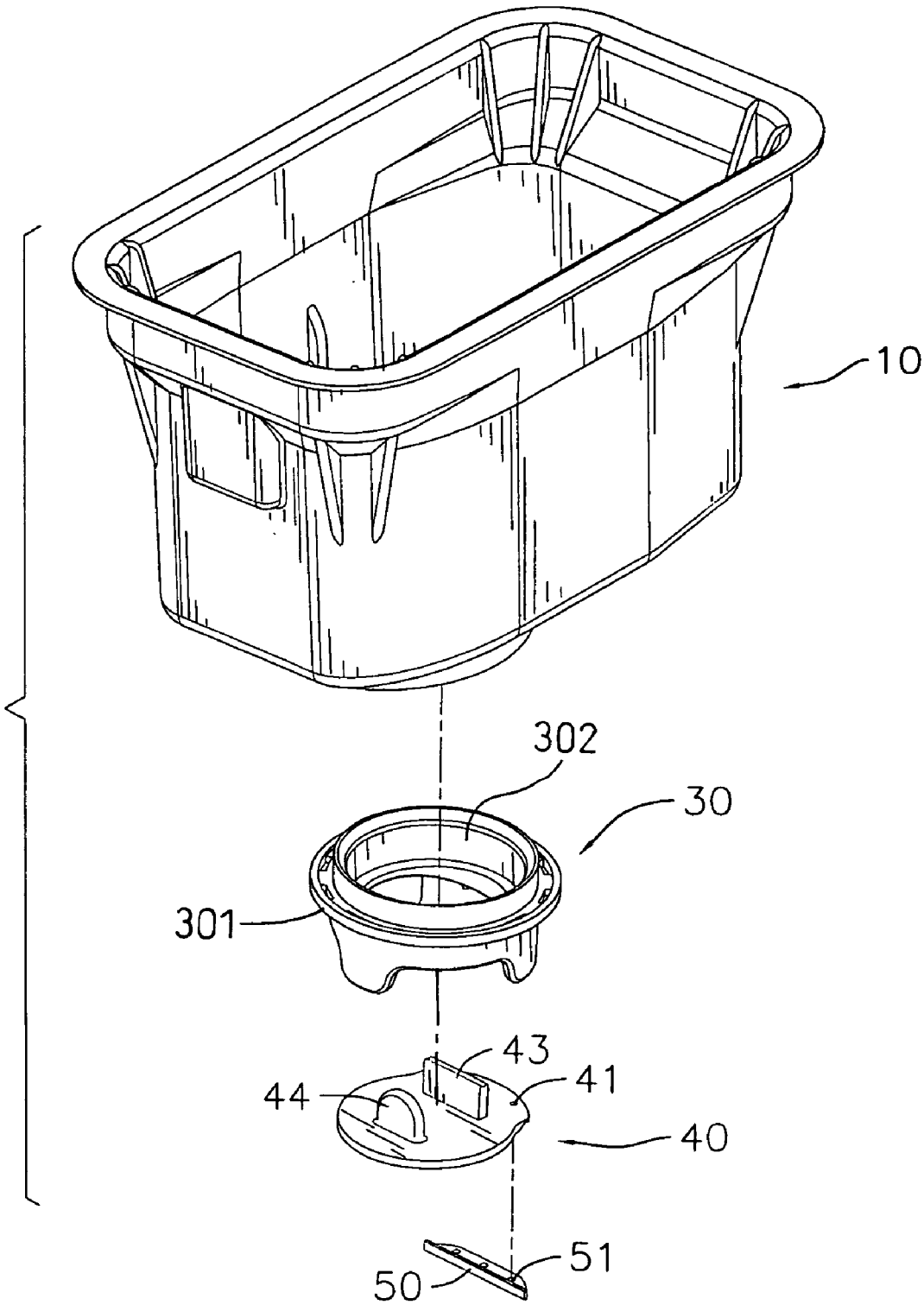
FIG. 3 is an exploded perspective view of a pump mounting case and a valve of the bidirectional air pump assembly in FIG. 1.
Figure 4:
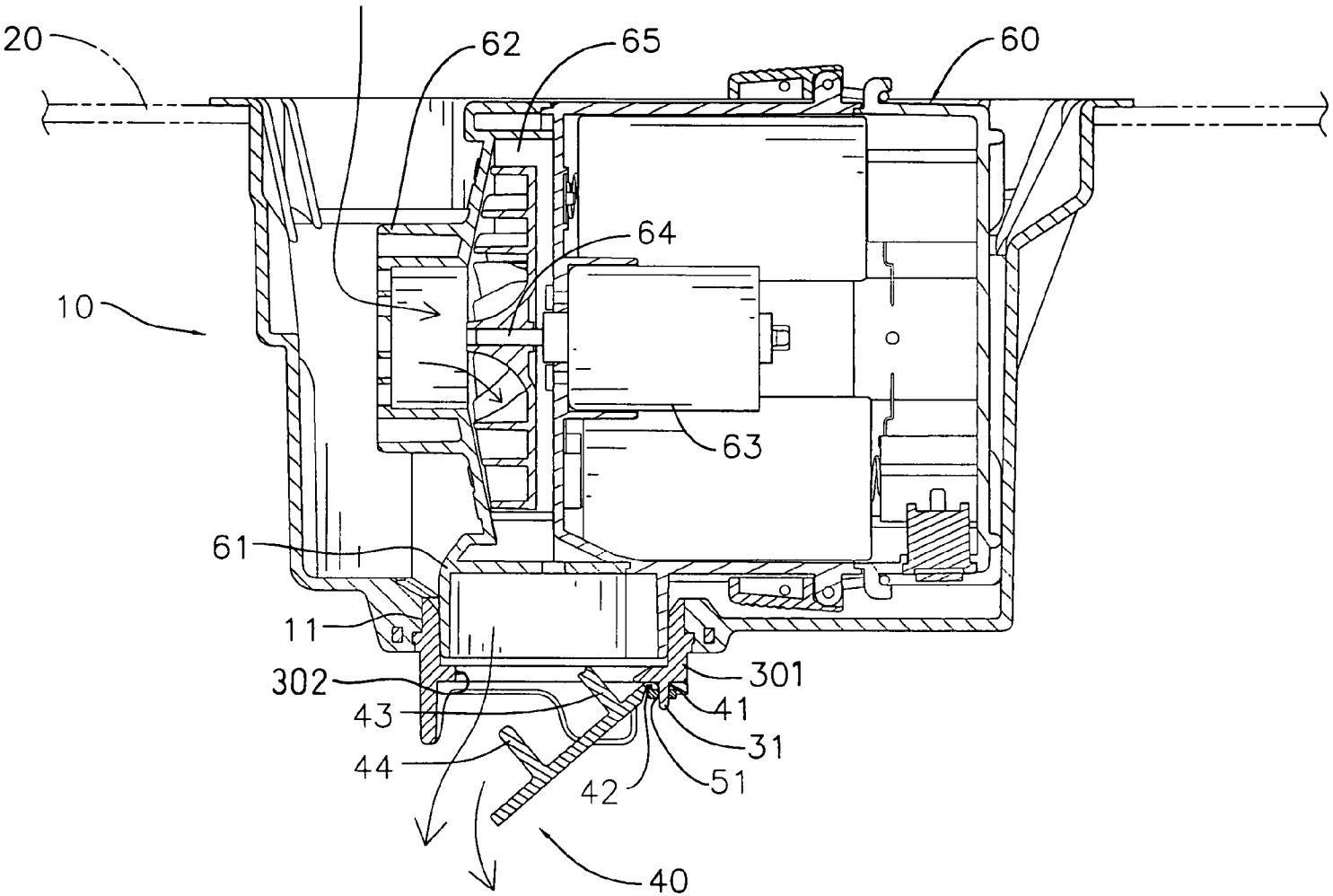
FIG. 4 is an operational, partial cross sectional side plan view of the bidirectional air pump assembly in FIG. 1 with an air pump pumping air into an inflatable object.

With reference to FIGS. 1 and 2, a preferred embodiment of a bidirectional air pump assembly for inflatable objects in accordance with the present invention comprises a pump mounting case (10), a valve (30) and an air pump (60). With further reference to FIGS. 3 and 4, the pump mounting case (10) is mounted inside an inflatable object (20) and has a top (not numbered), a bottom (not numbered), a top cavity (not numbered) and a valve mounting hole (11). The top cavity is defined in the top to receive and hold the air pump (60). The valve mounting hole (11) is defined through the bottom and communicates with the top cavity.

The valve (30) is fitted and held in the valve mounting hole (11) and comprises an adapter (301), a valve disk (40) and a clamp (50). The adapter (301) may be annular, is mounted and held in the valve mounting hole (11) and comprises a valve body (not numbered) and multiple protrusions (31). The valve body has a top (not numbered), a bottom (not numbered) and a valve port (302). The valve port (302) is defined vertically through the valve body. The protrusions (31) are formed integrally from the bottom of the valve body.

The valve disk (40) is attached to the bottom of the valve body and comprises a disk body (not numbered), a primary disk stop (43) and a secondary disk stop (44). The disk body may be flexible or foldable and has a top (not numbered), a bottom (not numbered), multiple through holes (41) and a transverse groove (42). The through holes (41) are defined through the top and correspond respectively to the protrusions (31) on the valve body of the adapter (301) to connect the disk body to the protrusions (31). The transverse groove (42) is defined in the bottom adjacent to the through holes (41). The primary and the secondary disk stops (43, 44) are formed on and protruded from the top of the disk body and may be parallel to each other.

The clamp (50) is attached to the bottom of the disk body to connect the valve disk (40) to the adapter (301) and comprises a stationary bar (not numbered) and a transverse bar (not numbered). The stationary bar has a top (not numbered) and multiple though holes (51). The through holes (51) are defined through the top and correspond respectively to the protrusions (31). The protrusions (31) extended out of the through holes (41) of the disk body are respectively fitted and held in the through holes (51) in the clamp (50) so that the clamp (51) connects the valve disk (40) to the adapter (301). The transverse bar protrudes from the top of the stationary bar and is received in the transverse groove (42) to segment the disk body into a movable portion and a stationary portion. The stationary portion of the disk body is held with the protrusions (31) by the clamp (50). The movable portion selectively covers the valve port (302). The primary and the secondary disk stops (43, 44) are formed on the movable portion.

The air pump (60) is detachably mounted in the pump mounting case (10) and comprises a housing (not numbered), a motor (63) and an impeller (65). The housing has a supply port (62) and a discharge port (61). The motor (63) is mounted in the housing and has a shaft (64). Either the supply port (62) or the discharge port (61) selectively connects to the valve port (302) of the adapter (301). The impeller (65) is mounted on and rotated by the shaft (64) to draw air into the housing through the supply port (62) and expel the incoming air from the housing through the discharge port (61).

With reference to FIG. 4, the bidirectional air pump assembly is used to pump air into the inflatable object (20) by connecting the discharge port (61) to the valve port (302) in the valve body of the adapter (301). Therefore, the air pump (60) will force air into the inflatable object (20) through the valve port (302) to cause the inflatable object (20) to inflate to its full-inflated size.

Figure 5:
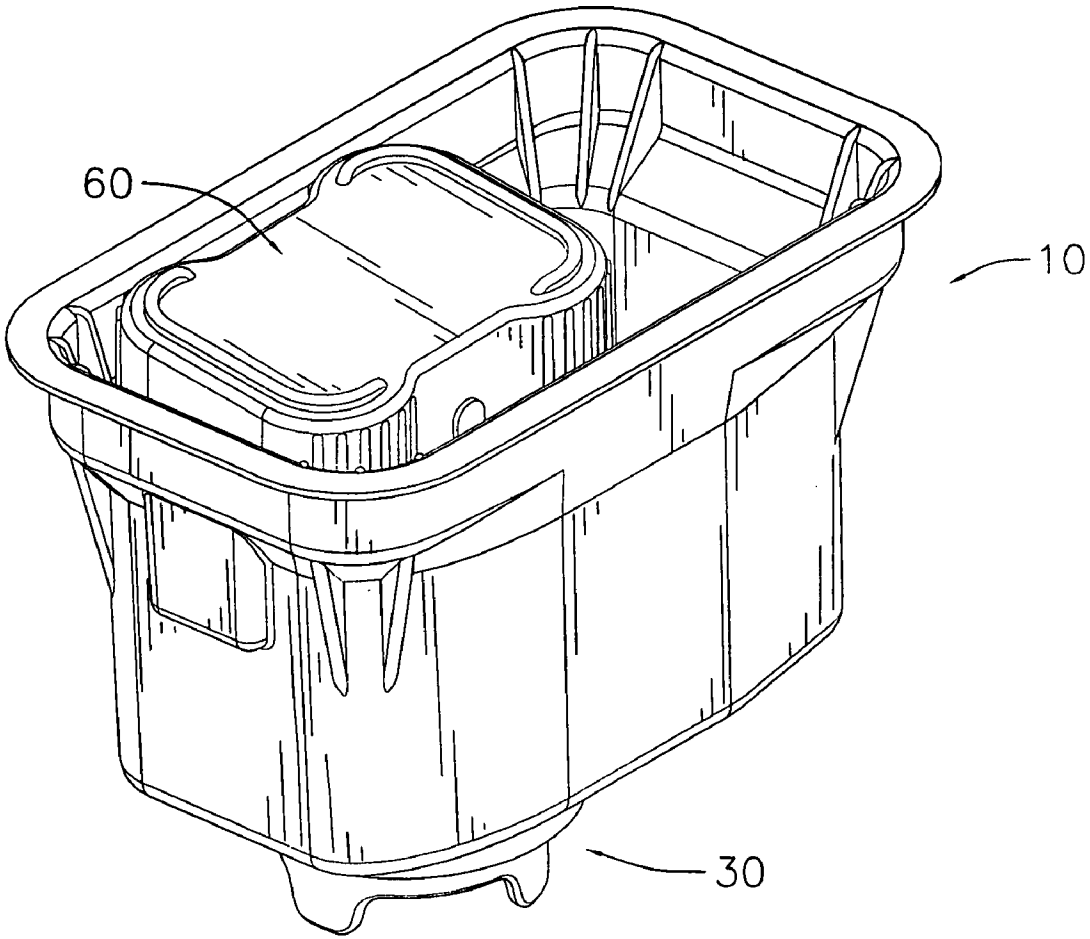
FIG. 5 is a perspective view of the bidirectional air pump assembly in FIG. 2 with the air pump mounted to draw air out of an inflated object.
Figure 6:
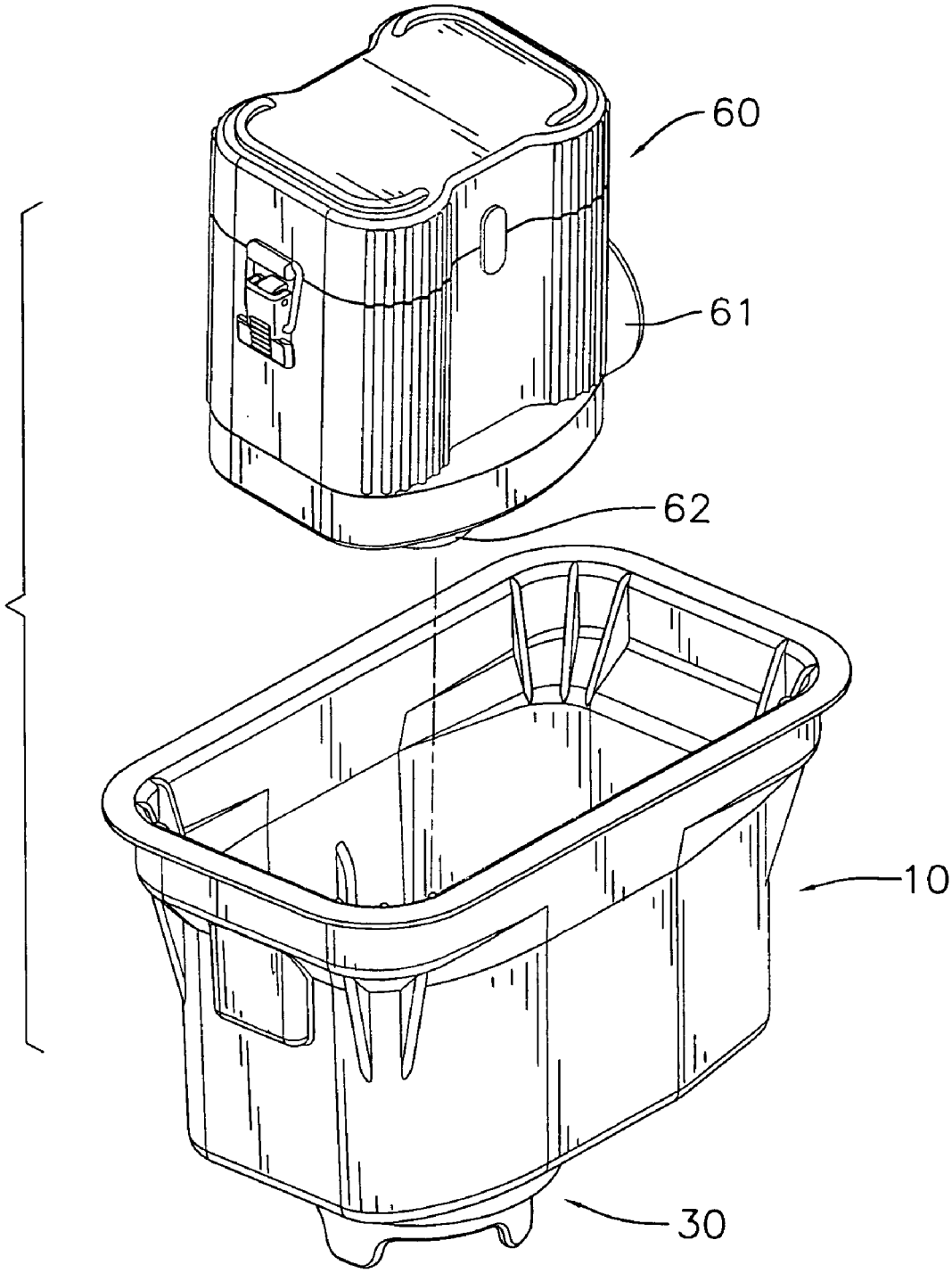
FIG. 6 is a partially exploded perspective view of the bidirectional air pump assembly in FIG. 5.
Figure 7:
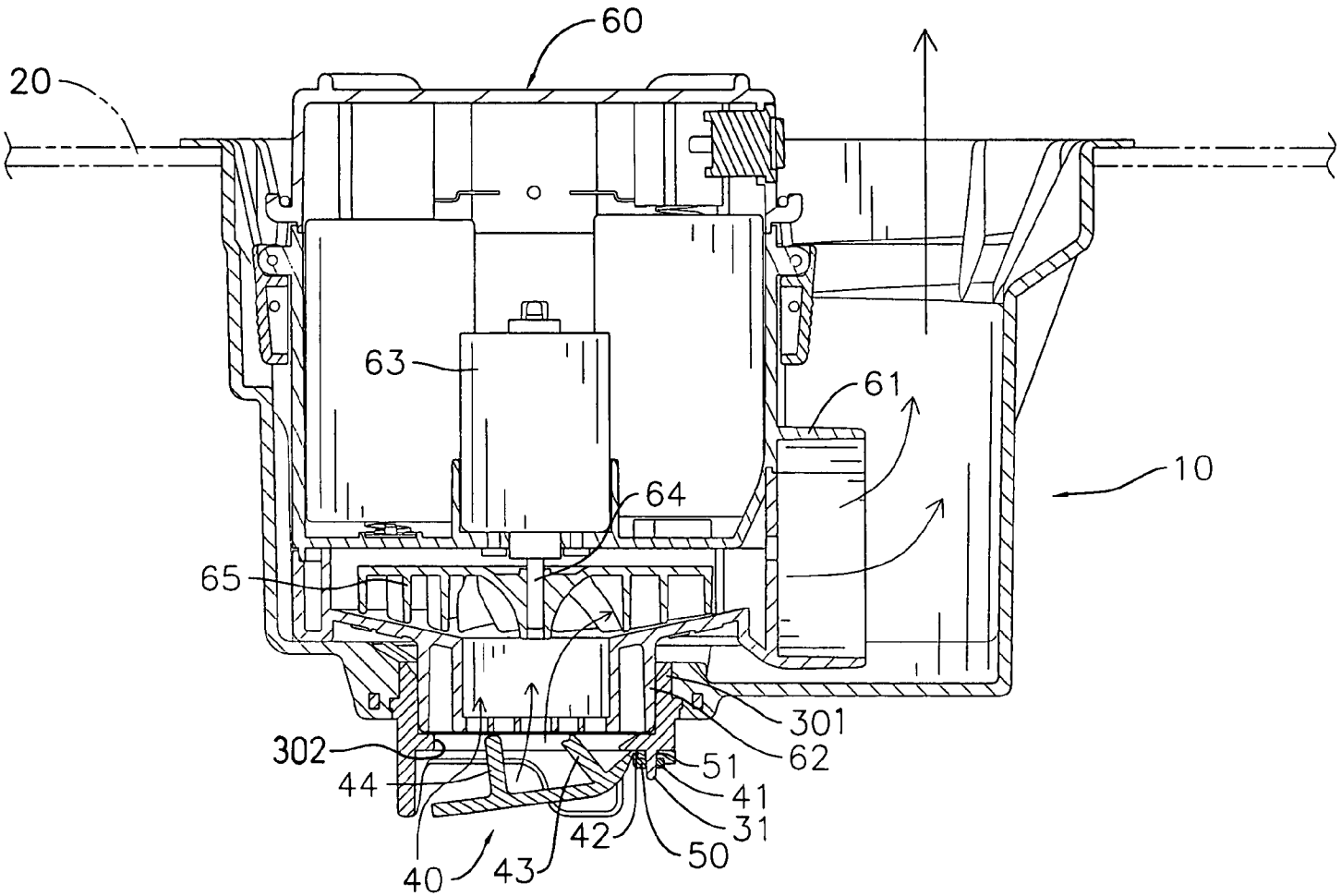
FIG. 7 is an operational, partial cross sectional side plan view of the bidirectional air pump assembly in FIG. 5.

With reference to FIGS. 5 to 7, the bidirectional air pump assembly removes air from an inflatable object (20) by connecting the supply port (62) to the valve port (302). The air pump (60) draws the air out of the inflatable object (20), which simultaneously pushes the movable portion of the disk body toward the valve port. However, the primary and the secondary disk stops (43, 44) abut the housing of the air pump (60) at the supply port (62), which forms a gap (not numbered) between the disk and the bottom of the valve body. The gap keeps the disk body of the valve disk (40) from completely closing the valve port (302). Therefore, the air pump (60) can pump air out of the inflatable object (20), which quickly reduces the size of the inflatable object (20).

Consequently, the bidirectional air pump assembly can be used to either pump air into or draw air out of an inflatable object. The air pump assembly will save a lot of time and effort to remove the air from the inflatable object when the bidirectional air pump assembly is used to remove the air from an inflatable object. There is no need to manually squeeze the air out of the inflatable object, and time and burdensome work are avoided.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the scope of the appended claims.

What is claimed is:

1. A bidirectional air pump assembly for inflatable objects and the bidirectional air pump assembly comprising:

a pump mounting case having a top, a bottom, a top cavity defined in the top and a valve mounting hole defined through the bottom and communicating with the top cavity;

a valve held in the valve mounting hole and comprising an adapter mounted in the valve mounting hole and comprising a valve body having a top, a bottom and a valve port defined through the top and the bottom of the valve body; and a valve disk attached to the bottom of the valve body and comprising a disk body having a top and a bottom and at least one disk stop formed on and protruded from the top of the disk body; and an air pump detachably mounted in the top cavity of the pump mounting case and having a housing with a supply port and a discharge port that selectively connect to the valve port;

wherein the at least one disk stop abuts the housing of the air pump at the supply port to form a gap between the disk body and the bottom of the valve body, and the gap keeps the disk body of the valve disk from completely closing the valve port when the air pump draws air out through the valve port.

2. The bidirectional air pump assembly as claimed in claim 1 further comprising a clamp attached to the bottom of the disk body to connect the valve disk to the valve body of the adapter.

3. The bidirectional air pump assembly as claimed in claim 2, wherein the valve body of the adapter further has multiple protrusions formed on the bottom of the valve body;

the disk body further has multiple through holes defined through the top and corresponding respectively to the protrusions and a transverse groove defined in the bottom adjacent to the through holes to divide the disk body into a movable portion and a stationary portion, the at least one disk stop is formed on the movable portion and the clamp holds the stationary portion in place; and the clamp comprises a stationary bar having a top and multiple though holes defined through the top and corresponding respectively to the protrusions and a transverse bar protruded from the top of the stationary and received in the transverse groove;

wherein each of the protrusions is held in a corresponding one of the through holes of the disk body and a corresponding one of the through holes of the stationary bar.

4. The bidirectional air pump assembly as claimed in claim 3, wherein the valve body of the adapter is annular.

* * * * *